United States Patent [19]

Culling

[11] Patent Number: 4,927,602

[45] Date of Patent: May 22, 1990

[54] HEAT AND CORROSION RESISTANT ALLOYS

[75] Inventor: John H. Culling, St. Louis, Mo.

[73] Assignee: Carondelet Foundry Company, St. Louis, Mo.

[21] Appl. No.: 413,288

[22] Filed: Sep. 27, 1989

[51] Int. Cl.[5] ..... C22C 30/02

[52] U.S. Cl. ..... 420/586

[58] Field of Search ..... 420/586, 586.1

[56] References Cited

U.S. PATENT DOCUMENTS 3,127,265 3/1964 Avery ..... 420/585

4,443,406 4/1984 Sykekawa et al. ..... 420/585

*Primary Examiner*—Upendra Roy

*Assistant Examiner*—David W. Schumaker

*Attorney, Agent, or Firm*—Senniger, Powers, Leavitt and Roedel

[57] ABSTRACT

Heat and corrosion resistant alloys suitable for use in the manufacture of structral parts for industrial furnaces and like installations where such parts must possess high resistance to oxidation in addition to exceptional levels of hot strength, and which can be air melted and cast or forged. The alloys consist essentially of between about 35% and about 46% by weight nickel, between about 25% and about 29% by weight chromium, between about 10% and about 13% by weight cobalt, between about 5.5% and about 8% by weight tungsten, between about 0.2% and about 1.5% by weight columbium (niobium), between about 0.2% and about 1.5% by weight zirconium, from about 0.05% to about 0.5% by weight titanium, between about 0.3% and about 0.9% by weight carbon, up to about 1.5% by weight manganese, up to about 2% by weight silicon, up to about 0.3% nitrogen and the balance essentially iron.

7 Claims, No Drawings

HEAT AND CORROSION RESISTANT ALLOYS

This invention relates to heat and corrosion resistant alloys suitable for use in the manufacture of structural parts for industrial furnaces and like installations where such parts must possess high resistance to oxidation in addition to exceptional levels of hot strength, and which can be air melted and cast or forged. The alloys consist essentially of between about 35% and about 46% by weight nickel, between about 25% and about 29% by weight chromium, between about 10% and about 13% by weight cobalt, between about 5.5% and about 8% by weight tungsten, between about 0.2% and about 1.5% by weight columbium (niobium), between about 0.2% and about 1.5% by weight zirconium, from about 0.05% to about 0.5% by weight titanium, between about 0.3% and about 0.9% by weight carbon, up to about 1.5% by weight manganese, up to about 2% by weight silicon, up to about 0.3% by weight nitrogen and the balance essentially iron.

BACKGROUND OF THE INVENTION

A series of standard alloys (known as (H-type alloys) have been developed for service in industrial furnaces and similar installations requiring moderately low hot strength as well as, almost always, resistance to attack by some combination of hot gases. These alloys almost always contain intentional additions of up to 0.9% by weight of carbon, because they derive much of their hot strength from the cabides that are thus formed. These alloys are generally referred to as heat-resistant alloys even though they must almost always resist the deleterious effects of some combination of hot gases.

While carbon content is sometimes increased in heat resistant alloys there are limits to the beneficial effects of intentional carbon additions. In any given grade of heat resistant alloy, increasing carbon levels eventually reduces hot ductility,. thermal fatigue strength, and thermal and mechanical shock resistance as well as melting point. Accordingly, carbon levels in those alloys are generally less than about 1% by weight.

These standard heat resistant alloys may be generally contrasted in several ways to stainless steels and related corrosion resistant alloys intended primarily for service in various corrosive fluids and other substances at temperatures below a few hundred degrees Farenheit. For example, carbon is detrimental in most corrosive service so that corrosion resistant alloy specifications may allow maximum carbon levels of 0.08%, 0.05%, 0.03% or even less.

Thus, while some stainless steels may be otherwise quite similar to some heat resistant alloys with respect to elemental analysis, the very low carbon levels of the former cause them to have much lower hot strengths than the related heat resistant grades.

By far the most widely employed corrosion resistant alloys are the 18% Cr-8% Ni types. However, the analogous higher-carbon heat resistant grades are not much employed in furnace and similar applications, in large measure because they tend to corrode rapidly at temperatures above about 1650° F. Since most furnace applications involve service well above this temperature, by far the most commonly employed grades of heat resistant alloys are the 25% Cr-12% Ni and 25% Ni types, which are known in their castings form as types HH and HK respectively. When greater resistance to thermal fatigue, thermal shock or carburization is required, the more expensive HT grade of 35% Ni-16% Cr is often employed. The HP grade, or 35% Ni-25% Cr is somewhat of a compromise between the HK and HT grades and combines good resistance to both oxidizing and carburizing atmospheres with higher hot strengths in the 1800° to 2000° F. range.

Another contrasting and somewhat specialized series of alloys generally referred to as superalloys owe their development to the advent of the gas turbine or jet engine. The most demanding service in these engines is found in the rotary turbine blades with equal corrosion resistance but somewhat less hot strength being required by the matching stator vanes. In these engines improved fuel efficiency came with higher operating temperatures. In the 1945-55 period of their development, in which blade temperatures increased from about 1400° F. to about 1650° F., chromium levels of about 15% to 22% provided sufficient resistance to hot gas corrosion at operating temperatures.

After 1955 or thereabout, a continuing trend toward lower chromium content was established. As a result, improvements in these blade alloys followed two paths initially, namely, modified cobalt-base alloys and nickel-base alloys. Cobalt-base alloys having increased hot strength were developed by formation of increasing amounts of carbides. But the hot strengthening effects of chromium carbides is somewhat limited so that cobalt-base alloys began to employ ever increasing quantities of the more effective carbide-forming elements molybdenum, tungsten, columbium, or even tantalum. The parallel development of improved nickel-base alloys was characterized by the development of hot strength principally by formation of so-called gamma-prime-phase precipitates, which are complex compounds of nickel with various quantities of titanium and aluminum. Eventually, the effects of the two methods of achieving hot strength were partially combined so that gamma prime-forming titanium and aluminum was present along with the carbide-forming elements with various proportions of nickel and cobalt.

Unfortunately, the carbide-forming elements as well as the gamma prime-forming elements all tend to reduce the matrix structural stability of these alloys. Therefore, as operating temperature demands increased, higher quantities of these two classes of elements were required to produce sufficient hot strengths at the higher application temperatures. In order to maintain matrix structural stability, chromium contents were reduced to levels of about 12%, 10%, 9%, 8% or even 6%. Since aluminum helps confer hot gas corrosion resistance, the increase in aluminum content to the 4% to 8% levels somewhat offset the deficiency resulting from decreased chromium content. On the negative side, however, such alloys must be melted and cast in vacuum or inert gas atmospheres due to their high aluminum contents as well as to the higher titanium content. A further problem is that vacuum or inert gas melting and casting processes are far too expensive for production of furnace and similar industrial parts. Hence, the superalloys developed for gas turbines or jet engines have turned out to the quite unsuited for most other industrial applications.

As a result, the need for alloys having improved Properties over those of the standard H-type alloys at reasonable cost, while widely recognized for decades remains unfilled. Yet, the materials performance demands of reforming, ethylene pyrolysis, coal gasification, iron ore reduction and other high temperature processes, are requiring and will continue to require heat resistance Properties beyond those of the HK-type alloys, which has held the major share of the market in the past. Specifically, the most desired property increases over the HK-type are in corrosion resistance, carburization resistance, creep and rupture strength and hot ductility at moderate materials cost. Alloys which have been developed to provide those improved properties fall into three general categories: improvements in the HK-base; improvements in the HP-base; and alloys of even higher total strategic element contents for the severest service.

The first significant improvement in reasonable cost alloys for high temperature applications combined with moderate increase in hot strength over standard HP grade was disclosed in U.S. Pat. No. 2,540,107 to English et al, which describes alloys of 40%–60% Ni, 22%–34% Cr, 4%–6.5% W, and 0.35%–0.75%C. An alloy of nominal composition of 48% Ni, 28% Cr and 5% W is commercially known as NA22H and was intended for service up to 2200° F. as compared to the H-type alloys which corrode severely at temperatures of 2100° F. or less.

Avery, U.S. Pat. No. 3,127,265, discloses the most significantly improved alloys to the present. An alloy falling within the Avery teachings contains nominally 35% Ni, 26% Cr, 15% Co, 5%W and 15% Fe, and is marketed under the trade name Supertherm. The primary improvements Provided by this alloy are increased life expectancy and lowered creep rate.

Later, in U.S. Pat. No. 3,607,250, English et al disclosed an alloy which was essentially the NA22H alloy plus about 3% Co, which is known as Super NA22H. However, while the hot corrosion resistance of the newer alloy is equal to that of Supertherm, its hot strength is inferior to Supertherm over the entire useful temperature range.

British patent No. 1,046,603, of 1965, discloses nickel-base alloys containing 26%–38% Cr and 10%–25% W. An alloy containing nominally 48.7% Ni, 34% Cr, 16% W and impurities. This alloy has been known commercially as MoRe2 and is intended for service up to 2500° F. However, MoRe2 serves to demonstrate the problem of lowered structural stability in such alloys. Carbon, nitrogen, nickel and cobalt tend to promote the stable desired matrix structure, while chromium, tungsten, molybdenum, colubium, tantalum, aluminum, titanium and other hardening and strengthening elements tend to destabilize or alter the matrix crystal structure to some extent. Therefore, this second group of elements must be somewhat limited in relation to the contents of the elements of the first group. Otherwise, hot strength, ductility, corrosion resistance or other properties will suffer. In the case of MoRe2, hot strength and corrosion resistance above about 2200° F. are superior to those of Supertherm and others, but MoRe2 is exceedingly expensive and of inferior hot strength below about 2200° F. It has therefore never been extensively used for commercial applications.

Also, in the mid-1950's, workers at the U.S. Naval Boiler and Turbine Laboratory began development of extremely corrosion resistant alloys of nominally 50% Ni-50% Cr and 40% Ni-60% Cr content, which were intended to resist the very corrosive effects of fuel-oils containing high amounts of sodium and vanadium compounds. These alloys had poor hot strengths, though the hot strength of the 50% Ni-50% Cr grade was slightly improved in subsequent work by the addition of about 1.5% Cb.

These very high chromium alloys and the MoRe2 alloy are examples of how hot strength may be sacrificed to obtain increased hot corrosion resistance. On the other hand, the gas turbine blade alloys are examples of sacrificing hot corrosion resistance to obtain the ultimate in hot strength at very high materials cost. However, there has remained a great need for improved hot strength in alloys approximately equal in hot corrosion resistance to those of U.S. Pat. No. 3,127,265 at moderate cost.

SUMMARY OF THE INVENTION

It is therefore an object of this invention to provide heat resistant alloys which have hot strength and rupture life properties at temperatures above about 1600° F. which are superior to those of the alloys of U.S. Pat. No. 3,127,265, which have equivalent hot gas corrosion resistance at temperatures above about 1800° F. and which have approximately the same total strategic element content and materials cost. It is an additional object of the invention to provide such alloys having sufficient tensile elongations and hot ductilities so that they are weldable and capable of being forged. Yet another object of the invention is to provide such alloys which may be readily melted and cast in ordinary air with ordinary melting equipment and by ordinary casting equipment and techniques without undue difficulties.

According to this invention alloys are provided which consist essentially by weight percentages of from about 35%–46% Ni, from about 25%–29% Cr, from about 10%–13% Co, from about 5.5%–8% W, from about 0.2%–1.5% Cb, from about 0.2%–1.5% Zr, from about 0.05%–0.5% Ti, from about 0.3%–0.9% C, up to about 2% Si, up to about 1.5% Mn, up to about 0.3% N and minor trace amounts of such impurities as may be encountered in formulating such alloys, and the balance essentially iron.

DETAILED DESCRIPTION OF THE INVENTION

The present invention is directed to heat resistant alloys suitable for castings or forged shapes for service in industrial furnaces and similar installations requiring higher hot gas corrosion resistance than that of the standard alloys along with higher hot strengths than these alloys as well as those of the prior art.

The components of the alloys of the invention are:

| | |
|---|---|
| Nickel | 35–46% by weight |
| Chromium | 25–29% |
| Cobalt | 10–13% |
| Tungsten | 5.5–8% |
| Columbium | 0.2–1.5% |
| Zirconium | 0.2–1.5% |
| Titanium | 0.05–0.5% |
| Carbon | 0.3–0.9% |
| Manganese | up to 1.5% |
| Silicon | up to 2% |
| Nitrogen | up to 0.3% |
| Iron | essentially the balance |

The alloys of the invention must contain at least 25% Cr to provide adequate corrosion resistance to most industrial hot gases at temperature above about 2000° F. However, the presence of tungsten, columbium (niobium) and zirconium to raise hot strength imposes limits upon the maximum permissible chromium levels since they are all ferrite formers. Hot gas corrosion resistance is affected not only by chromium content but also by the coefficient of thermal expansion as well as the content of some other elements.

Molybdenum drastically reduces hot gas corrosion resistance of the alloys of the invention and is therefore excluded. Columbium also reduces corrosion resistance but to a lesser extent than molybdenum. On the other hand columbium increases hot strength considerably and is included in the alloys of the invention in an amount up to about 1.5%, preferably to a maximum of about 1.2%.

Tungsten, zirconium and titanium were all found to reduce hot gas corrosion to some extent and therefore to partially compensate for the presence of columbium in the alloys of the invention. The alloys of the present invention have been found to provide their best strength and corrosion properties at fairly high tungsten contents, with about 6% to 7% being optimum.

The addition of zirconium also aids the tungsten and chromium in reducing corrosion and helps to increase hot strength substantially. However, zirconium must be held to a maximum of about 1.5% in alloys of the invention because it is a ferrite forming element and somewhat favors destabilization of the austenitic matrix crystal structure.

Titanium behaves somewhat like zirconium but is an element of much lower density. Consequently, lumps of titanium or even ferrotitanium float on the surface of the liquid metal during the melting of the alloys. Titanuim also oxidizes very readily. Accordingly, titanuim tends to give erratic and poor recovery during alloy melting in air atmospheres, particularly in relatively larger amounts. Nevertheless, titanium has been found to be a desirable addition to alloys of the invention. Therefore, in order to overcome the problems associated with the addition of titanuim, it may be added to in the form of a master alloy consisting of at least 1.8 pounds of tungsten per pound of titanuim in the master alloy. This provides a master alloy of a least the density of solid nickel so that such an alloy would lie at the bottom of the melt both during its dissolution and, therefore, be isolated from the air. In a similar manner, a master alloy consisting of at least 0.7 pound of tungsten per pound of zirconium could be formulated to provide similar additions of zirconium to the final alloys of the invention.

Even small amounts of titanium form carbides within metallic grains and also retard coalescence of the carbides of all types (strengtheners) over time at elevated temperatures. Hence titanium extends service life. Zirconium apparently does the same, mostly at grain boundaries; therefore, zirconium also increases hot strength and extends service life.

While nickel is not present in the earth's crusts in plentiful supply, cobalt is considerably scarcer and found only in fewer areas than nickel. Thus, one disadvantage of commercial prior art alloys, such as those of U.S. Pat. No. 3,127,265, is their relatively high cobalt content. The alloy sold as Supertherm, for example, has a preferred cobalt content of 13%–17%, and usually contains about 15% Co. The alloys of present invention on the other hand, are formulated with a maximum of 13% Co. Furthermore, while cobalt increases hot strength in Ni-Cr-Fe alloys, it is inferior to nickel as a stabilizer of the desired face-centered-cubic matrix structure. Also, the alloys of this invention, with their slightly higher nickel content and lower cobalt content as compared to those of the '265 patent have improved corrosion resistance.

With all of the above changes in alloying element contents as compared to the alloys of the '265 patent, good hot gas corrosion resistance is retained at temperatures above about 2000° F. However, chromium content cannot exceed about 29% without reducing hot strength to undesirable levels.

There have been numerous heat and corrosion resistant alloys in which iron content must be held to a maximum of less than 2%–3%. However, it is desirable to be able to include iron in alloys of the type to which the invention is directed in order to permit some use of ferroalloys, as compared to all pure element additions, in their formulation. Also, a tolerance for some iron lowers the required nickel content and reduces the likelihood of lost melts due to contamination of iron pick-up from the furnace linings used to melt such iron-containing alloys as stainless steels.

Alloys of the invention may contain as little as about 35% Ni in many applications. However, when maximum hot strength at higher temperatures is required alloys of the invention should contain nickel to the high side of the range usually 40%–46%.

Carbon and nitrogen are both powerful stabilizers of the desired face-centered-cubic matrix structure as well as contributing significantly to increased hot strength. However, nitrogen must not exceed the solid solubility limit of about 0.3%, or gas holes and similar defects will occur in the solid metal of air melted alloys. Also, nitrogen is a fairly expensive addition when employed as a component of alloy additions. Of course, some nitrogen is often recovered during air melting, but carbon is ordinarily employed as the principal hot strength-increasing element in alloys of the instant type. Carbon has been employed in amounts over 1% in some heat resistant alloys, but such alloys have poor cold ductility and reduced thermal shock resistance and weldability. Consequently, alloys of the present invention are limited to a maximum of about 0.9%° C., with an optimum content for most applications of about 0.55% C.

Small additions of such elements of relatively large ionic diameter, such as Ce, La, Ca, etc., (see *Metalle and Legierungen fur hohe Temperaturen,* Julius Springer, Berlin, Germany, 1940) may be made to alloys of the invention for further improvement in some of their properties without detriment to other properties.

For maximum hot strength at lower temperatures, of the order of 1660°–1800° F., it has been found desirable to restrict the alloys of the invention to the following ranges of proportions:

| | |
|---|---|
| Nickel | 35–46% by weight |
| Cobalt | 11–13% |
| Chromium | 25–27% |
| Tungsten | 5.6–7.6% |
| Columbium | 0.9–1.2% |
| Zirconium | 0.25–1.0% |
| Titanium | 0.1–0.3% |
| Carbon | 0.50–0.65% |
| Silicon | 0.40–0.85% |
| Manganese | 0.10–0.50% |
| Iron | essentially balance |

For maximum resistance to hot gas corrosion, it has been found desirable to restrict the alloys of the invention to the following ranges of proportions:

| | |
|---|---|
| Nickel | 35–46% by weight |
| Cobalt | 11–13% |
| Chromium | 27–29% |
| Tungsten | 5.6–8% |
| Columbium | 0.2–0.6% |
| Zirconium | 0.3–0.9% |
| Titanium | 0.05–0.3% |
| Carbon | 0.40–0.65% |
| Silicon | 0.60–1.50% |
| Manganese | 0.10–0.30% |
| Iron | essentially balance |

For excellent balance between hot strength, good resistance to carburization and hot gas corrosion, along with good mechanical properties and weldability, the following ranges of proportions of elements have been found to be especially desirable:

| | |
|---|---|
| Nickel | 40–46% by weight |
| Cobalt | 11–13% |
| Chromium | 26–28% |
| Tungsten | 5.6–7.6% |
| Columbium | 0.9–1.2% |
| Zirconium | 0.25–0.65% |
| Titanium | 0.1–0.3% |
| Carbon | 0.50–0.65% |
| Silicon | 0.40–0.85% |
| Manganese | 0.10–0.50% |
| Iron | essentially Balance |

The following examples further illustrate the invention.

EXAMPLE 1

One hundred pound heats of several different alloys were prepared in accordance with the invention as well as numerous other comparative alloys not of the invention. Each of the heats was air melted in a high frequency induction furnace and then air cast into well risered standard tensile bar keel blocks.

The compositions of a number of alloys not of the invention are set forth in Table I. A standard tensile test bar from each of these samples was stressed at 4,000 pounds per square inch load at 1800° F. until failure. All compositions throughout the specification are by weight percentage unless otherwise specified.

TABLE I

| ALLOY NUMBER | Ni | Cr | Co | W | Cb | Zr | C | Mn | Si | N | Fe |
|---|---|---|---|---|---|---|---|---|---|---|---|
| 804 | 35.88 | 26.12 | — | — | — | — | .48 | .89 | 1.16 | — | 35.47 |
| 805 | 49.52 | 48.22 | — | — | 1.53 | — | .02 | .09 | .07 | .05 | .5 |
| 806 | 37.16 | 27.82 | 6.61 | 5.58 | — | — | .34 | .82 | .66 | — | 21.01 |
| 807 | 28.65 | 24.05 | — | 2.29 | 1.51 | .02 | .39 | .59 | .61 | .24 | 41.65 |
| 808 | 32.27 | 24.39 | — | 3.78 | — | .39 | .41 | .49 | .48 | .23 | 37.56 |
| 809 | 26.42 | 24.48 | .07 | 2.91 | — | — | .26 | .76 | .62 | .19 | 44.29 |
| 810 | 33.67 | 28.83 | — | 3.90 | — | .38 | .41 | .85 | .80 | .24 | 30.92 |
| 811 | 37.25 | 29.25 | 12.28 | 4.55 | — | .40 | .22 | .77 | .82 | .36 | 14.10 |
| 812 | 51.93 | 44.63 | — | 1.56 | — | — | .23 | .24 | .34 | — | 1.07 |
| 813 | 43.64 | 53.09 | — | 1.27 | — | — | .34 | .65 | .73 | — | .32 |
| 814 | 53.06 | 40.05 | — | 5.01 | — | — | .63 | .81 | .44 | — | — |

The rupture life and total elongation at time of failure are set forth in Table II.

TABLE II

| PROPERTIES AT 1800° F., 4,000 p.s.i. STRESS | | |
|---|---|---|
| Alloy Number | Life Hours | Elongation |
| 804 | 766.1 | 31% |
| 805 | 38.8 | 9% |
| 806 | 622.3 | 23% |
| 807 | 192.4 | 25% |
| 808 | 245.6 | 16% |
| 809 | 159.4 | 11% |
| 810 | 283.1 | 35.2% |
| 811 | 78.5 | 25% |
| 812 | 216.8 | 41% |
| 813 | 19.9 | 13% |
| 814 | 116.3 | 11% |

Those alloys of greater than 40% Cr levels would have useful hot gas corrosion resistance to about 2300° F. or even 2400° F., but, none of the alloys of Table I had adequate hot strength for purposes of this invention. Alloy 804 was a standard HP-type alloy and lasted the longest of any alloy of this group.

EXAMPLE 2

The compositions of a number of alloys that are variations of the basic HP type are set forth in Table III. These samples were stressed at 7,000 pounds per square inch load at 1800° F. The rupture life and total elongation at time of fracture are set forth in Table IV.

TABLE III

| ALLOY NUMBER | Ni | Cr | Co | W | Cb | Zr | C | Mn | Si | N | Fe |
|---|---|---|---|---|---|---|---|---|---|---|---|
| 804 | 35.88 | 26.12 | — | — | — | — | .48 | .89 | 1.16 | — | 35.47 |
| HP-S2 | 33.55 | 24.82 | — | 2.02 | — | — | .42 | 1.03 | 1.06 | — | 37.10 |
| HP-S3 | 34.81 | 24.66 | .16 | 4.85 | — | — | .41 | .86 | .76 | — | 33.49 |
| HP-S4 | 35.12 | 25.16 | .09 | 10.03 | — | — | .35 | .26 | 1.10 | — | 27.89 |
| HP-S5 | 35.21 | 25.12 | — | 10.52 | — | .28 | .49 | 1.02 | 1.13 | — | 26.22 |
| HP-S6 | 35.06 | 25.48 | — | — | — | .49 | .51 | .99 | 1.24 | — | 36.23 |
| HP-S7 | 34.16 | 24.09 | — | — | 1.26 | — | .39 | .65 | .95 | — | 38.50 |
| HP-S8 | 35.89 | 24.86 | 5.06 | — | — | — | .46 | .87 | .82 | — | 32.04 |
| HP-S9 | 35.13 | 25.08 | 12.17 | — | — | — | .48 | 1.12 | .96 | — | 25.06 |
| HP-S10 | 36.02 | 25.25 | 12.09 | 5.08 | — | — | .46 | .76 | .89 | — | 19.45 |
| HP-S11 | 36.22 | 26.18 | 11.95 | 7.61 | — | .52 | .59 | .24 | 1.05 | — | 15.64 |
| HP-S12 | 37.13 | 25.35 | 12.03 | 7.02 | 1.15 | — | .57 | .28 | .66 | — | 15.81 |
| HP-S13 | 39.75 | 26.96 | 12.61 | 7.71 | — | — | .55 | .21 | 1.25 | .13 | 10.83 |

TABLE IV

| PROPERTIES AT 1800° F., 7,000 p.s.i. STRESS | | |
|---|---|---|
| Alloy Number | Hours | Life Elongation |
| 804 | 37.0 | 18.3% |
| HP-S2 | 67.4 | 6.1% |
| HP-S3 | 97.1 | 8.1% |
| HP-S4 | 38.3 | (7.5%) |
| HP-S5 | 50.1 | 7.5% |
| HP-S6 | 54.5 | 5.3% |
| HP-S7 | 41.6 | 19.5% |
| HP-S8 | 50.8 | 6.5% |
| HP-S9 | 52.0 | 6.5% |
| HP-S10 | 41.2 | 15.5% |
| HP-S11 | 106.8 | 16.0% |
| HP-S12 | 208.6 | 15.3% |
| HP-S13 | 179.9 | 14.2% |

These results indicate that none of the variations altered the life of the basic HP-type alloy significantly. However, it is evident that when two or three elements selected from Co, W, Cb and Zr were added to the basic HP alloy, fairly substantial increases in rupture life were achieved.

EXAMPLE 3

The compositions of several alloys of the invention along with that of H-817, which is not of the invention are set forth in Table V. Test bars from each of these heats were tested at various temperatures and stress levels. The rupture life in hours for each test is set forth in Table VI.

TABLE V

| ALLOY NUMBER | Ni | Cr | Co | W | Cb | Zr | Ti | C | Mn | Si | N | Fe |
|---|---|---|---|---|---|---|---|---|---|---|---|---|
| H-815 | 37.42 | 26.08 | 11.89 | 7.04 | 1.03 | .26 | .21 | .55 | .54 | .86 | — | 14.12 |
| H-816 | 35.36 | 26.02 | 12.34 | 5.96 | .60 | .30 | .19 | .59 | .52 | .92 | — | 17.20 |
| H-818 | 44.66 | 26.15 | 12.02 | 6.99 | .99 | .41 | .15 | .53 | .13 | .83 | — | 7.05 |
| H-819 | 35.69 | 28.15 | 12.88 | 6.02 | .86 | .69 | .18 | .48 | .11 | .81 | — | 13.58 |
| H-822 | 35.13 | 26.64 | 12.44 | 7.11 | 1.18 | .96 | .22 | .52 | .21 | .56 | — | 14.75 |
| H-817 | 26.91 | 28.15 | 21.66 | 6.02 | .08 | .31 | .07 | .57 | .51 | .81 | — | 14.91 |

TABLE VI

| TEMPERATURE AND STRESS | RUPTURE LIFE, HOURS H-815 | H-816 | H-818 | H-819 | H-822 | H-817 |
|---|---|---|---|---|---|---|
| 1600° F. | | | | | | |
| 14,000 psi | 185.8 | 160.4 | 282.1 | 431.8 | 386.4 | 434.7 |
| 12,000 psi | 508.5 | 519.4 | 930.1 | — | — | — |
| 10,000 psi | 1881.4 | — | 3111.8 | — | — | — |
| 1800° F. | | | | | | |
| 7000 psi | 394.9 | 429.2 | 605.6 | 869.8 | 721.6 | 889.3 |
| 6000 psi | 766.4 | 920.8 | 1596.2 | — | — | — |
| 5000 psi | 2304.4 | — | 3542.2 | — | — | — |

These tests demonstrate how the combination of the elements Co, W, Cb, Zr and Ti in the proportions taught herein included as additions to the HP base alloys, along with the proportions of Ni, Cr and Co specified, provide alloys which achieve substantial improvement in hot strength over the base alloy.

Also, the results of the tests on the H-817 alloy demonstrate how deviation from the invention through higher cobalt and lower nickel, columbium and titanium content gave good life to 1900° F. but drastically reduced life at 2000° F.

It is impractical to test experimental alloys for periods of the order of 100,000 hours, which equals 11.4 years. Even 10,000 hour tests equal about 13.7 months. It has therefore been customary in programs for the development for alloys of this type to conduct hot tests with load stresses that produce instant failure within a period of from a few hundred to a few thousand hours. The results of such tests are then plotted on log-log charts from which 1000-hour life at a given temperature is obtained by interpolation. Ten-thousand-hour life values are also estimated from such plots by extrapolation, but such values are in some doubt.

Another method commonly employed is to plot the test results on semi-logarithmic charts as a Larson-Miller parameter, $P=T(C+\log t)$, in which P is the parametric value, T is the testing temperature of an alloy type under investigation on the absolute scale (either Kelvin or Rankine), C is a statistically determined constant for the alloy, and t is the time to failure in hours.

Both of the above methods yield the same results stress for 1000 hours of life at various temperatures. Stress values are set forth in Table VII for the instant alloys along with the values for the standard alloy and the values derived from tests of hundreds of production heats of Supertherm alloy, as well as the lower values for that alloy given in U.S. Pat. No. 3,127,265.

TABLE VII

| | STRESS, P.S.I., TO PRODUCE 1000-HOUR RUPTURE LIFE IN VARIOUS ALLOYS | | | |
|---|---|---|---|---|
| TEMPERATURE °F. | STANDARD HP | U.S. 3,127,265 | PRODUCTION HEATS OF SUPERTHERM | ALLOYS OF THE INVENTION |
| 1500 | 11,000 | — | 13,000 | 16,000 |
| 1600 | 7,500 | 9,200 | 9,900 | 12,000 |
| 1700 | 5,400 | — | 7,600 | 9,000 |
| 1800 | 3,600 | 4,500 | 5,500 | 6,600 |
| 1900 | 2,400 | 3,300 | 3,800 | 4,500 |
| 2000 | 1,500 | 2,250 | 2,400 | 3,000 |
| 2100 | 800 | 1,300 | 1,320 | 1,700 |

In the production of commercial heats according to the Supertherm specifications, I have observed that sometimes the tensile elongations at room temperature are low when the manganese content of the heats is allowed to reach 0.7% to 0.8%. Also, high totals of carbon plus nitrogen content in virtually all heat resistant alloys of this and similar types tend to give lower tensile elongations. Experience has shown that alloys of this type, whose room temperature elongations exceed about 6% or 7%, present no problems in ordinary production or repair welding.

The alloys of the invention were also tested at room temperature (75° F.) for strength and elongation. These values along with those for comparative alloy No. H-817 are set forth in Table VIII.

TABLE VIII

ROOM TEMPERATURE TENSILE VALUES

| ALLOY NUMBER | ULTIMATE TENSILE STRENGTH, PSI | YIELD STRENGTH, PSI | PERCENT TENSILE ELONGATION |
|---|---|---|---|
| H-815 | 74,500 | 41,400 | 6.0% |
| H-816 | 72,800 | 41,400 | 5.5% |
| H-818 | 71,700 | 42,500 | 7.0% |
| H-819 | 81,700 | 47,600 | 8.8% |
| H-822 | 82,600 | 51,200 | 7.5% |
| H-817 | 80,300 | 52,700 | 3.0% |

It may be seen from these values in comparison with the contents of the alloys as set forth in Table V that room temperature values for alloys of the invention are quite adequate and comparable to those for Supertherm when manganese contents are to the low side of the range. Manganese is a very important deoxidizing element in the production of ordinary low alloys steels and many others. However, the alloys of this invention contain silicon, zirconium, titanium, columbium, tungsten and chromium, all of which have some powers of deoxidation. Therefore, low manganese content in alloys of the invention present no steel making problems of this sort.

As various changes can be made in the alloys of the invention without departing from the scope of the invention, it is intended that all matter contained in the above description shall be interpreted as illustrative and not in a limiting sense.

What is claimed is:

1. An air meltable, weldable alloy having good hot gas corrosion resistance above about 1800° F. and exceptional hot strength above about 1600° F. and which can be cast or forged in air, consisting essentially of:

| | |
|---|---|
| Nickel | 35–46% by weight |
| Chromium | 25–29% |
| Cobalt | 10–13% |
| Tungsten | 5.5–8% |
| Columbium | 0.2–1.5% |
| Zirconium | 0.2–1.5% |
| Titanium | 0.05–0.5% |
| Carbon | 0.3–0.9% |
| Manganese | up to 1.5% |
| Silicon | up to 2% |
| Nitrogen | up to 0.3% |
| Iron | essentially the balance |

2. An alloy of claim 1 consisting essentially of:

| | |
|---|---|
| Nickel | 35–46% by weight |
| Chromium | 25–17% |
| Cobalt | 11–13% |
| Tungsten | 5.6–7.6% |
| Columbium | 0.9–1.2% |
| Zirconium | 0.25–1.0% |
| Titanium | 0.1–0.3% |
| Carbon | 0.50–0.65% |

-continued

| | |
|---|---|
| Silicon | 0.40–0.85% |
| Manganese | 0.10–0.50% |
| Iron | essentially the balance |

3. An alloy of claim 1 consisting essentially of:

| | |
|---|---|
| Nickel | 35–46% by weight |
| Chromium | 27–29% |
| Cobalt | 11–13% |
| Tungsten | 5.6–8% |
| Columbium | 0.2–0.6% |
| Zirconium | 0.3–0.9% |
| Titanium | 0.05–0.3% |
| Carbon | 0.40–0.65% |
| Silicon | 0.60–1.50% |
| Manganese | 0.10–0.30% |
| Iron | essentially the balance |

4. An alloy of claim 1 consisting essentially of:

| | |
|---|---|
| Nickel | 40–46% by weight |
| Chromium | 26–28% |
| Cobalt | 11–13% |
| Tungsten | 5.6–7.6% |
| Columbium | 0.9–1.2% |
| Zirconium | 0.25–0.65% |
| Titanium | 0.1–0.3% |
| Carbon | 0.50–0.65% |
| Silicon | 0.40–0.85% |
| Manganese | 0.10–0.50% |
| Iron | essentially the balance |

5. An alloy according to any one of claims 1 to 4 wherein the tungsten content is in the range of about 6–7%.

6. An air meltable, weldable alloy having good hot gas corrosion resistance above about 1800° F. and which can be cast or forged in air, consisting essentially of:

| | |
|---|---|
| Nickel | 44.6% by weight |
| Chromium | 26.1 |
| Cobalt | 12% |
| Tungsten | 7 |
| Columbium | 1 |
| Zirconium | 0.4 |
| Titanium | 0.15 |
| Carbon | 0.5 |
| Manganese | 13 |
| Silicon | 0.8 |
| Iron | essentially the balance |

7. An air meltable, weldable alloy having good hot gas corrosion resistance above about 1800° F. and exceptional hot strength above about 1600° F. and which can be cast or forged in air, consisting essentially of:

| | |
|---|---|
| Nickel | 35.1 by weight |
| Chromium | 26.6 |
| Cobalt | 12.4 |
| Tungsten | 7.1 |
| Columbium | 1.2 |
| Zirconium | 1 |
| Titanium | 0.2 |
| Carbon | 0.5 |
| Manganese | 0.2 |
| Silicon | 0.6 |
| Iron | essentially the balance |

* * * * *